US010012034B2

(12) United States Patent
Eppink

(10) Patent No.: US 10,012,034 B2
(45) Date of Patent: Jul. 3, 2018

(54) MUD MOTOR BEARING PACK LOWER END WITH CATCH RING

(71) Applicant: Smith International, Inc., Houston, TX (US)

(72) Inventor: Jay M. Eppink, Spring, TX (US)

(73) Assignee: SMITH INTERNATIONAL, INC., Houston, TX (US)

( * ) Notice: Subject to any disclaimer, the term of this patent is extended or adjusted under 35 U.S.C. 154(b) by 0 days.

(21) Appl. No.: 14/767,980

(22) PCT Filed: Feb. 11, 2014

(86) PCT No.: PCT/US2014/015717
§ 371 (c)(1),
(2) Date: Aug. 14, 2015

(87) PCT Pub. No.: WO2014/126889
PCT Pub. Date: Aug. 21, 2014

(65) Prior Publication Data

US 2015/0368985 A1 Dec. 24, 2015

Related U.S. Application Data

(60) Provisional application No. 61/764,955, filed on Feb. 14, 2013.

(51) Int. Cl.
*E21B 7/00* (2006.01)
*E21B 17/03* (2006.01)
(Continued)

(52) U.S. Cl.
CPC ..... *E21B 17/03* (2013.01); *E21B 3/00* (2013.01); *E21B 4/003* (2013.01); *E21B 4/02* (2013.01); *E21B 7/00* (2013.01)

(58) Field of Classification Search
USPC ..... 175/57, 320; 166/380
See application file for complete search history.

(56) References Cited

U.S. PATENT DOCUMENTS 3,352,362 A * 11/1967 Lebourg ..... E21B 33/1291 166/140
6,273,195 B1 * 8/2001 Hauck ..... E21B 33/127 166/129

(Continued)

FOREIGN PATENT DOCUMENTS

WO 2014126889 A2 8/2014

OTHER PUBLICATIONS

International Search Report for International Application No. PCT/US2014/015717 dated Nov. 20, 2014.

(Continued)

*Primary Examiner* — Taras P Bemko

(57) ABSTRACT

It is desirable to secure a lower end of a down hole assembly in the event of a down hole failure, such as a fractured drive shaft, enabling recovery of the bottom hole assembly and drill bit. To secure the lower end of the down hole assembly, a catch apparatus according to embodiments herein may be used, the catch apparatus including a rotating bearing having a distal end threadably coupled to a distal portion of a drive shaft. The apparatus may also include a stationary bearing having a proximal end threadably coupled to a distal end of an outer housing. A catch ring may be threadably coupled to a proximal end of the rotating bearing, the catch ring having a shoulder radially overlapping a shoulder of the stationary bearing.

22 Claims, 2 Drawing Sheets

(51) Int. Cl.

| | |
|---|---|
| ***E21B 4/00*** | (2006.01) |
| ***E21B 3/00*** | (2006.01) |
| ***E21B 4/02*** | (2006.01) |

(56) References Cited

U.S. PATENT DOCUMENTS

| | | | | |
|---|---|---|---|---|
| 7,445,061 | B1 | 11/2008 | Falgout, Jr. et al. | |
| 8,025,110 | B2 | 9/2011 | Falgout, Jr. et al. | |
| 2010/0187013 | A1* | 7/2010 | Falgout, Jr. ..... | H02K 7/08 175/106 |
| 2010/0314172 | A1 | 12/2010 | Underwood et al. | |
| 2012/0205158 | A1 | 8/2012 | Barnes et al. | |
| 2012/0325561 | A1 | 12/2012 | LeBlanc et al. | |

OTHER PUBLICATIONS

International Preliminary Report on Patentability issued in corresponding International Application PCT/US2014/015717 dated Aug. 18, 2015. 14 pages.

* cited by examiner

MUD MOTOR BEARING PACK LOWER END WITH CATCH RING

FIELD OF THE DISCLOSURE

The present disclosure relates to methods and devices for down hole drilling. More particularly, the present disclosure relates to an apparatus for preventing the lower part of a drive shaft from parting from the working section of the drive shaft in the event of a down hole failure. Further, the present disclosure relates to a method for assembly of said apparatus. Further still, the present disclosure relates to a method of drilling a subterranean formation.

BACKGROUND

Drilling motors, or mud motors, are included in a drill string to provide additional rotational force to a drill bit while drilling. Mud motors use the hydraulic force of drilling fluid, or drilling mud, sent down hole through the drilling motor to drive its rotation. Particularly, the drilling fluid is passed through at least one stage consisting of a stationary stator vane, which is coupled to the drill string, and a rotating rotor assembly, which is coupled to a drive shaft of the drill string. The vanes of the stator are commonly configured to direct the drilling fluid into the rotor vanes. The rotor vanes then impart rotation to the drive shaft, which provides an additional driving force for to drill bit.

Mud motors are characterized by a high speed or rotations per minute ("RPM") to torque ratio. As a result, the drive shaft of the motor may experience high bending loads during operation. In some cases, this high bending load may result in a down hole failure. In the event of a down hole failure, the drive shaft may fracture and result in a lower end of the drive shaft parting from the working section of the drive shaft. In such a situation, a catch device may be necessary to prevent losing the lower end of the drive shaft down hole.

U.S. Pat. No. 8,025,110 discloses a catch device having a sleeve secured to a portion of the output shaft and an interference structure that is secured to the general housing. The interference structure extends into the capture groove and is configured to secure the sleeve and output shaft in an event of a lower end of the output shaft parting from the rest of the output shaft.

U.S. Patent App. 2010/0314172 discloses a locking clutch and catch device for a down hole motor. The catch device includes a spacer secured to the drive shaft with a flange that extends radially outward to trap a lip of a mandrel stabilizer that extends radially inward in the event of the lower end of the drive shaft parting from the rest of the output shaft.

SUMMARY OF CLAIMED EMBODIMENTS

In one aspect, embodiments disclosed herein relate to an apparatus for securing a lower end of a down hole assembly. The apparatus may include: a rotating bearing, wherein a distal end of the rotating bearing is threadably coupled to a distal portion of a drive shaft; a stationary bearing, wherein a proximal end of the stationary bearing is threadably coupled to a distal end of an outer housing; and a catch ring threadably coupled to a proximal end of the rotating bearing, wherein a shoulder of the catch ring is configured to radially overlap a shoulder of the stationary bearing.

In another aspect, embodiments disclosed herein relate to a method of assembling an apparatus for securing a lower end of a down hole assembly. The method may include: threadably engaging a distal end of a rotating bearing to a distal portion of a drive shaft of a down hole assembly; disposing a stationary bearing over the rotating bearing; threadably engaging a catch ring to a proximal end of the rotating bearing, wherein the catch ring is configured to protrude radially outward from the rotating bearing; sliding an outer housing over the distal portion of the driveshaft; and threadably engaging the stationary bearing to a distal end of the outer housing, wherein a shoulder of the outer housing is configured to overlap the catch ring in a radial direction.

In another aspect, embodiments disclosed herein relate to a method of drilling a subterranean formation. The method may include: disposing a catch apparatus on a drill string, wherein the catch apparatus comprises: a rotating bearing, wherein a distal end of the rotating bearing is threadably coupled to a distal portion of a drive shaft; a stationary bearing, wherein a proximal end of the stationary bearing is threadably coupled to a distal end of an outer housing; and a catch ring threadably coupled to a proximal end of the rotating bearing, wherein a shoulder of the catch ring is configured to radially overlap a shoulder of the stationary bearing. The drill string and catch apparatus may then be emplaced into a borehole for performing drilling operations.

This summary is provided to introduce a selection of concepts that are further described below in the detailed description. This summary is not intended to identify key or essential features of the claimed subject matter, nor is it intended to be used as an aid in limiting the scope of the claimed subject matter.

DETAILED DESCRIPTION

Generally, embodiments disclosed herein relate to methods and devices for use during down hole drilling. More specifically, the present disclosure relates to an apparatus for securing a lower end of a down hole assembly and a method of assembly of said apparatus. Further, the present disclosure relates to a method of drilling a subterranean formation.

As used herein, the term proximal refers to a portion of the down hole assembly that is nearer the surface or the drilling rig and the term distal refers to a portion of the down hole assembly that is nearer the drill bit, bottom hole assembly, or the bottom of the hole.

Figure 1:
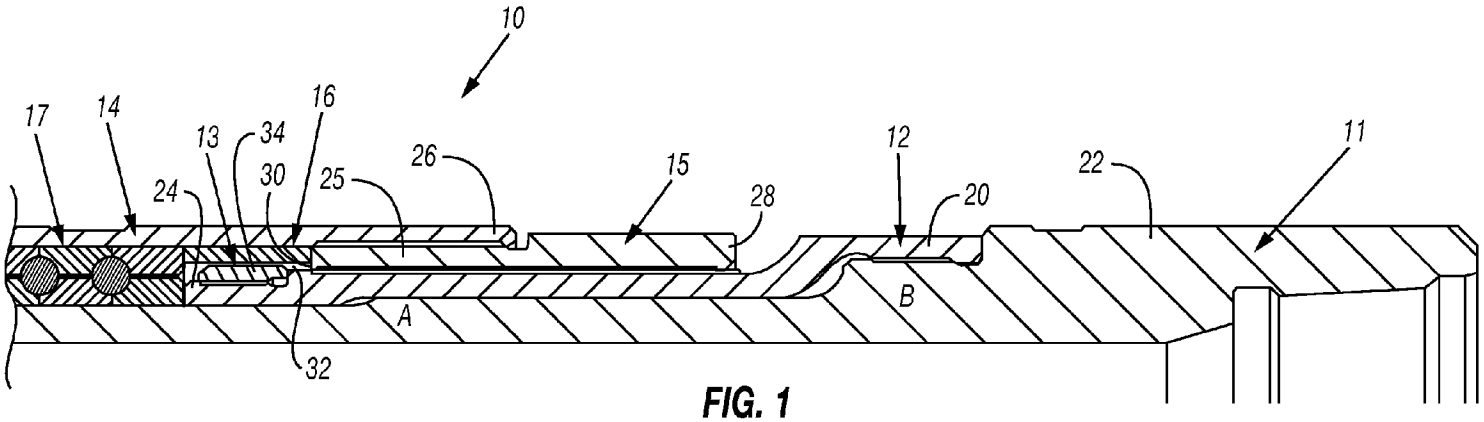
FIG. 1 is a cross-sectional view of a catch apparatus according to embodiments herein.

Referring initially to FIG. 1, a cross-sectional view of an apparatus for securing a lower end of a down hole assembly (catch assembly 10) according to embodiments of the present disclosure is shown. In this embodiment, the catch assembly 10 may include a rotating bearing 12, a stationary bearing 15, and a catch ring 13. In some embodiments, a spacer ring 16 may also be included in the catch assembly.

The catch assembly 10 may be disposed on a distal portion of a down hole assembly. In some embodiments, the down hole assembly may be a steerable down hole assembly. The down hole assembly may include a mud motor encased in an outer housing configured to drive a drill bit coupled to a distal end of a drive shaft. According to embodiments of the present disclosure, the catch assembly 10 may be arranged such that a distal end 20 of the rotating bearing 12 may be coupled to a distal portion 22 of the drive shaft 11.

The catch ring 13 may be coupled to a proximal end 24 of the rotating bearing 12, and a proximal end 25 of the stationary bearing 15 may be coupled to a distal end 26 of the outer housing 14.

As illustrated in FIG. 1, the coupling means may be threads. In some embodiments, these threads may be left hand threads such that normal rotation of the drive shaft does not result in unwinding of the threads and disassembly of the catch apparatus. In other embodiments, these threads may be right hand threads such that in the event of shaft breakage, retrieval operations do not result in unwinding of the threads and disassembly of the catch apparatus.

The rotating bearing 12 may be threadably coupled to the drive shaft 11 such that the rotating bearing 12 rotates with the drive shaft 11 during normal drilling operation. By having the rotating bearing 12 threadably coupled to the drive shaft 11, the transition zone (i.e., the lower portion of the assembly between the outer housing 14 and the drive shaft 11) of the drive shaft 11 may be effectively sealed from drilling mud, which could corrode, erode, and fatigue the drive shaft 11.

Figure 2:
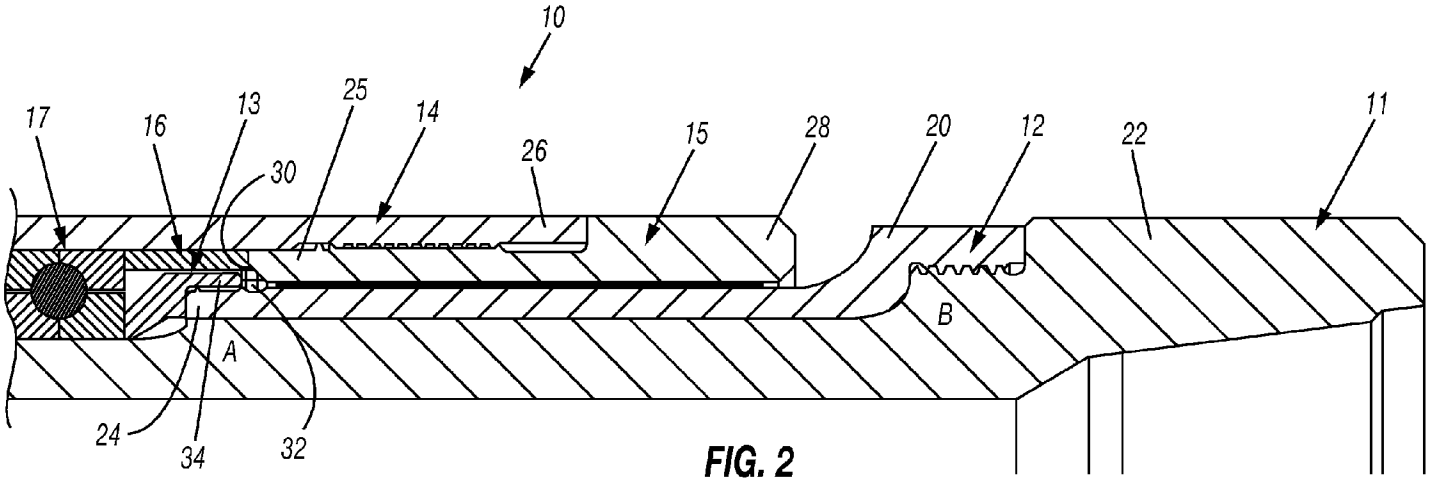
FIG. 2 is a cross-sectional view of a catch apparatus according to embodiments herein.

FIG. 2 is a cross-sectional view of an apparatus for securing a lower end of a down hole assembly (catch assembly 10) according to embodiments of the present disclosure, where like numerals represent like parts. In this embodiment, catch assembly 10 is similar to that as illustrated in FIG. 1, albeit with slightly different shapes/configurations of the respective components.

As shown in FIGS. 1 and 2, in some embodiments, the distal end 28 of the stationary bearing 15 may have an outer diameter that is substantially the same as, or slightly less than, the outer diameter of the distal end 20 of the rotating bearing 12. Further, in some embodiments, a proximal end 25 of the stationary bearing 15 may comprise an upwardly facing shoulder 30. The upwardly facing shoulder 30 may be configured to have an inner diameter that is less than the outer diameter of a portion of the catch ring 13, such as a downwardly facing shoulder 32 proximate the distal end 34 of the catch ring 13. In some embodiments the upwardly facing shoulder 30 may be substantially flat, as shown in FIG. 1. In some other embodiments, the upwardly facing shoulder 30 may be beveled, as shown in FIG. 2.

Referring to FIGS. 1 and 2, the catch ring 13 may be coupled to a proximal end 24 of the rotating bearing 12 such that the catch ring 13 is protrudes radially outward from the rotating bearing 12. The catch ring 13 may be a solid ring or a split ring, for example. Due to the radial protrusion of the catch ring 13, the distal end 34 of the catch ring 13 may include a downwardly facing shoulder 32. As discussed above, the inner diameter of the proximal end 25 of the stationary bearing 15 may be less than the outer diameter of the catch ring 13. This may allow the upwardly facing shoulder 30 of the stationary bearing 15 and the downwardly facing shoulder 32 of catch ring 13 to interfere in a radial direction, preventing downward movement of the catch ring 13 (and hence the rotating bearing 12 and the drive shaft 11) in the event of drive shaft failure.

Embodiments of the catch assembly may further include a spacer ring 16. As shown in FIGS. 1 and 2, the spacer ring 16 may be disposed radially between the catch ring 13 and the outer housing 14. The spacer ring 16 may be configured to abut the outer housing 15. In some embodiments, the spacer ring 16 may be formed integrally with the stationary bearing 15. In other embodiments, the spacer ring 16 may be coupled to the stationary bearing 15.

Figure 3:
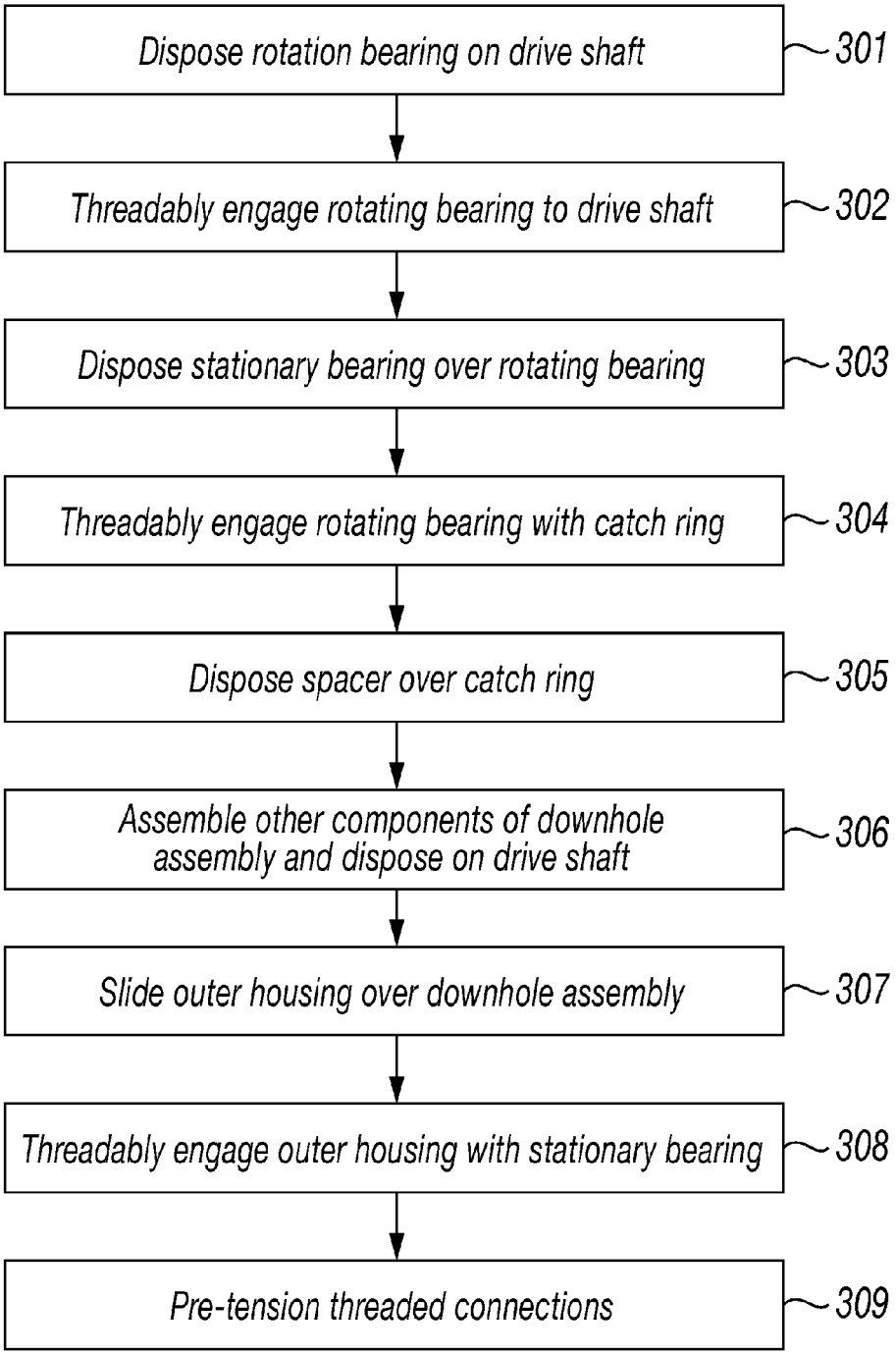
FIG. 3 is a flow diagram for a method of assembling a catch apparatus in accordance with the present disclosure.

FIG. 3 shows a flow diagram of a method for assembling the catch assembly 10. Referring to FIGS. 1 and 3 together, the rotating bearing may be disposed 301 on the distal portion of the drive shaft 11. The distal threads of the rotating bearing 12 may be threadably engaged 302 with threads located on distal portion of a drive shaft 11. The stationary bearing 15 may be disposed 303 over the distal portion of the rotating bearing 12. The catch ring 13 may then be threadably engaged 304 to the proximal end of the rotating bearing 12. The proximal portion of the down hole assembly may then be assembled, for example the thrust race 17 may be disposed 307 on the drive shaft 11 or within housing 14. Next, the outer housing 14 may be disposed on the drive shaft 11 by sliding 307 the outer housing 14 over the drive shaft and the down hole assembly as illustrated in FIGS. 1 and 2 (or, alternatively, sliding the assembly into the outer housing). Once the outer housing 14 is disposed on the drive shaft 11, the outer housing 14 may be threadably engaged 308 with the stationary bearing 15. Finally, the down hole assembly may be pre-tensioned 309 by torquing the threaded connections of the assembly.

In some embodiments, a spacer ring may be disposed 305 over the catch ring 13 before assembling and disposing the proximate portion of the down hole assembly on the drive shaft.

A catch assembly according to the description of the present disclosure may be used in drilling a subterranean formation. For example, the catch apparatus may be disposed on a distal portion of a down hole assembly in accordance with the description above. Next, drilling operations may be performed, such as by rotating a drill bit directly or indirectly coupled to the drive shaft. In other embodiments performing the drilling operations may further comprise applying torque to the drive shaft to rotate the drill bit.

In the event that a down hole failure occurs the operating fluid pressure may drop. An operator running the down hole assembly may recognize the pressure drop as indicative of a fractured drive shaft and may take corrective actions to prevent further damage and to retrieve the bottom hole assembly.

Referring to FIG. 1, in the event of a down hole failure, a fracture may occur at one of several points along the drive shaft. Two locations that are at a higher risk of fracturing are proximate points A and B, where the outer diameter of the drive shaft decreases. The drive shaft may also fracture at other locations along its length.

In the event that a fracture occurs above point B, the shoulder of the catch ring 13 and the shoulder of the stationary bearing 15 may interfere in a radial direction and prevent the rotating bearing from dropping down the hole. The threads coupling the rotating bearing 12 to the drive shaft may catch the distal portion of the drive shaft and prevent it from dropping down the hole. Necessarily, the threaded connections between the rotating bearing 12 and the drive shaft, the catch ring 13 and the rotating bearing 12, and the stationary bearing 15 and the outer housing should be capable of supporting the weight of the drive shaft and the components of the drill string coupled to the distal end of the drive shaft, including the drill bit. Additionally, the shear strength of the materials used to manufacture the catch ring and the stationary bearing should be sufficient to prevent shear and failure of the catch apparatus. In some embodiments, the shear strength of the catch assembly may be greater than about 50,000 pounds. The threaded couplings may be designed to have a similar strength before failure. Following the down hole failure and the successful catching of the bottom hole assembly with the catch apparatus, the drill string may be raised to retrieve the fractured drive shaft and the bottom hole assembly, perform the necessary repairs, and resume drilling operations. The above-noted strengths should be sufficient to not only handle the weight of downhole components, but also any additional forces as may be applied to the drill string, such as to jar a stuck bottom hole assembly loose to permit retrieval.

Due to the configuration of the elements of the catch assembly as illustrated in FIGS. 1 and 2 the outer diameter of the drive shaft 11 where the drive shaft 11 couples to the catch assembly may be determined independently of the diameters of the elements of the catch assembly. This may allow the outer diameter of the drive shaft to be maximized.

Including a catch device, such as those according to embodiments herein, may avoid the time and cost of recovering a drive shaft in the event of a down hole failure. Further, embodiments herein may also reduce the chances of a down hole failure occurring. Embodiments disclosed herein may also allow for a maximum drive shaft diameter to be used, as well as providing sealing of the transition zone of the drive shaft, improving overall operations of the assembly and long-term effectiveness of the component parts.

For example, embodiments herein may allow maximization of the diameter/thickness of the drive shaft while still allowing drill cuttings to be carried up the annulus between the borehole walls and the drill string, effectively mitigating the effect of large loads experienced by the drive shaft. A larger diameter drive shaft may also reduce the stress-magnifying effect of threads. With a larger diameter, the stress-magnifying effect is less of a concern than it would be if the threads were on a smaller diameter part.

As another example, corrosion and wear of the down hole assembly may affect the overall strength of the drive shaft. Sealing of the transition zone of the drive shaft according to embodiments herein, where the drive shaft cross sectional diameter changes, may desirably reduce corrosion and erosion of parts.

Although only a few example embodiments have been described in detail above, those skilled in the art will readily appreciate that many modifications are possible in the example embodiments without materially departing from the apparatus, systems, and methods disclosed herein. Accordingly, all such modifications are intended to be included within the scope of this disclosure as defined in the following claims.

What is claimed is:

1. An apparatus for securing a lower end of a down hole assembly comprising:

a rotating bearing, wherein a distal end of the rotating bearing is threadably coupled to a distal portion of a drive shaft;

a stationary bearing, wherein a proximal end of the stationary bearing is threadably coupled to a distal end of an outer housing; and a catch ring threadably coupled to a proximal end of the rotating bearing, wherein a shoulder of the catch ring radially overlaps a shoulder of the threadably coupled stationary bearing and the outer housing, wherein the catch ring defines threads on an inner diameter thereof, wherein the rotating bearing defines threads on an outside surface thereof, and wherein the threads of the catch ring and the threads of the rotating bearing engage one another to maintain a relative positioning of the catch ring and the rotating bearing.

2. The apparatus of claim 1, wherein the shoulder of the outer housing comprises an upwardly facing shoulder disposed on a proximal end of the stationary bearing.

3. The apparatus of claim 1, wherein the shoulder of the catch ring is a downwardly facing distal shoulder.

4. The apparatus of claim 1, wherein the catch ring is configured to protrude radially outward from the rotating bearing.

5. The apparatus of claim 1, wherein the catch ring is a solid ring.

6. The apparatus of claim 1, wherein the shoulder of the outer housing is integral with the stationary bearing.

7. The apparatus of claim 1, wherein the shoulder of the outer housing comprises a ring which is separate from said stationary bearing.

8. The apparatus of claim 1, further comprising a spacer ring radially disposed between the catch ring and the outer housing.

9. The apparatus of claim 8, wherein the spacer ring is integrally formed with the stationary bearing.

10. The apparatus of claim 8, wherein the shoulder of the outer housing is formed integrally with said spacer ring.

11. The apparatus of claim 1, wherein the catch ring has a shear strength of at least 50,000 pounds.

12. The apparatus of claim 1, wherein the down hole assembly is steerable.

13. The apparatus of claim 1, wherein the shoulder of the stationary bearing is configured to interfere with the shoulder of the catch ring in a radial direction so as to prevent the rotating bearing from dropping when the drive shaft fractures.

14. A method of assembling an apparatus for securing a lower end of a down hole assembly comprising:

threadably engaging a distal end of a rotating bearing to a distal portion of a drive shaft of a down hole assembly;

disposing a stationary bearing over the rotating bearing;

threadably engaging a catch ring to a proximal end of the rotating bearing, wherein the catch ring is configured to protrude radially outward from the rotating bearing;

disposing an outer housing over the distal portion of the drive shaft; and threadably engaging the stationary bearing to a distal end of the outer housing, wherein a shoulder of the outer housing is configured to overlap the catch ring in a radial direction, wherein the catch ring defines threads on an inner diameter thereof, wherein the rotating bearing defines threads on an outside surface thereof, and wherein the threads of the catch ring and the threads of the rotating bearing engage one another to maintain a relative positioning of the catch ring and the rotating bearing.

15. The method of claim 14, further comprising disposing a spacer ring over the catch ring.

16. The method of claim 14, further comprising disposing a lock nut over the rotating bearing.

17. The method of claim 14, further comprising pre-tensioning the down hole assembly.

18. A method of drilling a subterranean formation, the method comprising:

disposing a catch apparatus on a drill string, wherein the catch apparatus comprises:

a rotating bearing, wherein a distal end of the rotating bearing is threadably coupled to a distal portion of a drive shaft;

a stationary bearing, wherein a proximal end of the stationary bearing is threadably coupled to a distal end of an outer housing; and a catch ring threadably coupled to a proximal end of the rotating bearing, wherein a shoulder of the catch ring radially overlapping a shoulder of the stationary bearing wherein the catch ring defines threads on an inner diameter thereof, wherein the rotating bearing defines threads on an outside surface thereof, and wherein the threads of the catch ring and the threads of the rotating bearing engage one another to maintain a relative positioning of the catch ring and the rotating bearing;

emplacing the drill string into a borehole; and performing drilling operations using the drill string.

19. The method of claim 18, wherein the drill string further comprises a drill bit directly or indirectly coupled to the drive shaft.

20. The method of claim 18, wherein performing drilling operations further comprises applying torque to the drive shaft to rotate a drill bit.

21. The method of claim 18, in the event of a down hole failure, further comprising catching a lower portion of the drill string with the catch apparatus.

22. The method of claim 21, further comprising retrieving the drill string and the caught lower portion from the borehole.

* * * * *